US012240665B2

(12) United States Patent
Zheng

(10) Patent No.: US 12,240,665 B2
(45) Date of Patent: Mar. 4, 2025

(54) PACKING BOX AND CARDBOARD STRUCTURE

(71) Applicant: ShenZhen YUTO Packaging Technology Co., Ltd., Shenzhen (CN)

(72) Inventor: Haixia Zheng, Shenzhen (CN)

(73) Assignee: SHENZHEN YUTO PACKAGING TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/517,638

(22) Filed: Nov. 2, 2021

(65) Prior Publication Data

US 2023/0026698 A1 Jan. 26, 2023

(30) Foreign Application Priority Data

Jul. 22, 2021 (CN) ..... 202121684833.6

(51) Int. Cl.
*B65D 5/50* (2006.01)
*B65D 5/42* (2006.01)
*B65D 81/05* (2006.01)

(52) U.S. Cl.
CPC ..... *B65D 5/5016* (2013.01); *B65D 5/4266* (2013.01); *B65D 81/05* (2013.01)

(58) Field of Classification Search
CPC ..... B65D 5/5016; B65D 81/02; B65D 75/00; B65D 79/00; B65D 57/0002; B65D 57/002; B65D 5/4266; B65D 5/35; B65D 5/035; B65D 5/4801
USPC ..... 206/521
See application file for complete search history.

(56) References Cited

U.S. PATENT DOCUMENTS 2,399,537 A * 4/1946 Belden ..... B65D 5/5016 206/418
5,193,741 A * 3/1993 Magruder ..... B65D 5/48046 229/120.09
5,857,612 A * 1/1999 Smith ..... B65D 5/58 229/120.04
5,871,147 A * 2/1999 Smith ..... B65D 5/5016 229/120.17
2003/0024851 A1* 2/2003 Auclair ..... B65D 5/5016 206/592

(Continued)

FOREIGN PATENT DOCUMENTS

KR 20220009752 A * 7/2020

*Primary Examiner* — Ernesto A Grano
*Assistant Examiner* — Symren K Sanghera
(74) *Attorney, Agent, or Firm* — Arch & Lake LLP

(57) ABSTRACT

The present disclosure relates to a packing box and a cardboard structure. The packing box includes: a box body, which further includes a bottom, a side wall and a containing space; the side wall connects to the bottom, and the containing space is formed by the bottom and the side wall; a carrying structure, positioned in the containing space; the carrying structure, including connecting parts and buffer parts, connects to the side wall with a bendable connection in one-piece structure; the buffer part is connected to both ends of the connecting part along the second direction, and the carrying structure is connected to the side wall through the connecting part; the buffer part is connected to the connecting part with a bendable connection, the buffer part abuts against the side wall with deformation; and the effective space inside the box changes with the deformation of the buffer part.

11 Claims, 7 Drawing Sheets

(56) References Cited

U.S. PATENT DOCUMENTS

| | | | | |
|---|---|---|---|---|
| 2018/0022500 | A1* | 1/2018 | Zhu | B65D 5/5014 206/775 |
| 2020/0114612 | A1* | 4/2020 | Singh | B31B 50/25 |
| 2020/0385164 | A1* | 12/2020 | Davis | B65D 5/0236 |
| 2022/0119150 | A1* | 4/2022 | Lee | B65D 5/5035 |

* cited by examiner

S0

S3

S33

S32

PACKING BOX AND CARDBOARD STRUCTURE

CROSS-REFERENCE TO RELATED APPLICATION

The present application is based on and claims the priority to the Chinese Patent Application No. 202121684833.6, filed on Jul. 22, 2021, the entire content of which is hereby incorporated by reference for all purposes.

TECHNICAL FIELD

The disclosure relates generally to the field of packing technology, and in particular, to a packing box and a cardboard structure.

BACKGROUND

The packing box is usually used to package objects. When these boxes are transported, vibrations and bumps can easily happen that will cause damage to objects. The packing boxes usually have poor buffer capacity, and effective protection of the objects is hardly to get during transportation. To improve the buffer effect, more additional buffer materials, such as foam, bubble paper, sponge, paper holder, and etc., are usually filled or set in the box. As a result, not only the cost but also the complexity of the packaging increases.

SUMMARY

The present disclosure provides a packing box and a cardboard structure.

The first aspect of the present disclosure provides a packing box, and the packing box includes a box body. The box body further includes: a bottom; a side wall that is connected to the bottom; a containing space that is bounded by the bottom and the side wall; and a carrying structure positioned in the containing space. The carrying structure comprises a connecting part and a buffer part, and the carrying structure connects to the side wall through the connecting part with a bendable connection. The buffer part is connected to both ends of the connecting part along a second direction, the buffer part abuts against the side wall with deformation, and effective space inside the box changes with the deformation of the buffer part.

The second aspect of the present disclosure provides a cardboard structure, and the cardboard structure includes a first surface, a second surface that is opposite to the first surface, a box body area and a carrying area. The box body area further includes a bottom area and a side wall area that are connected together. The side wall area and the bottom area are respectively configured to bend toward the first surface to form a side wall and a bottom, and the bottom and the side wall form a containing space. The carrying area is configured to bend toward the first surface to form a carrying structure; the carrying structure, including a connecting subarea and a buffer subarea, is positioned in the containing space; the buffer subarea connects to the connecting subarea; the connecting subarea and the buffer subarea are respectively configured to bend toward the first surface and the second surface at least once to form a connecting part and a buffer part; and the carrying structure connects to the side wall through the connecting part. The buffer part is connected to both ends of the connecting part along a second direction, the buffer part abuts against the side wall with deformation, and effective space inside the box changes with the deformation of the buffer part.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure.

DETAILED DESCRIPTION

Figure 1:
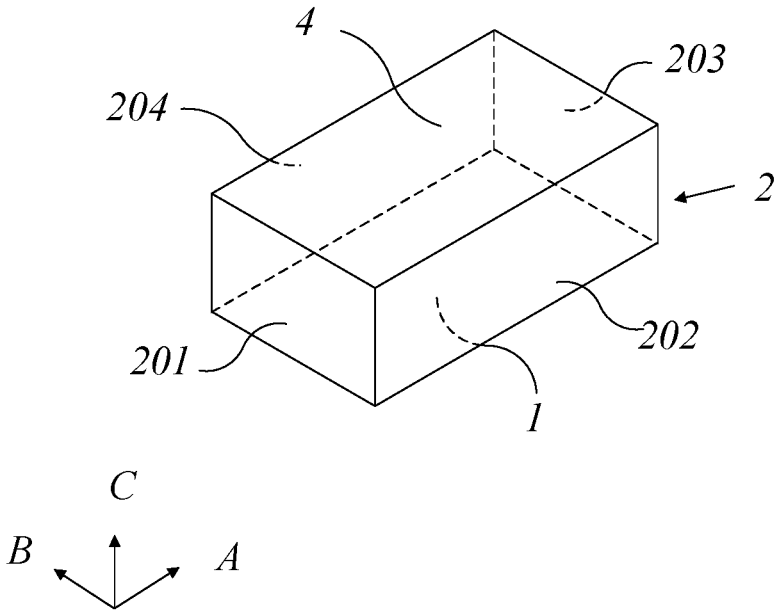
FIG. 1 is the schematic diagram of the packing box when it is closed according to one or more examples of the present disclosure.

Here, examples of the present disclosure will be described in detail, and examples thereof are shown in the accompanying drawings. When the following description refers to the drawings, unless otherwise indicated, the same reference numbers in different drawings indicate the same or similar elements. The examples described following do not represent all examples consistent with the present disclosure. On the contrary, they are merely examples of devices and methods consistent with some aspects of the disclosure as detailed in the appended claims.

It should be noted that in this application, the terms "include", "comprise" or any other variants thereof are intended to cover non-exclusive inclusion, so that a process, method, product or device including a series of elements not only those listed, but also those that are not explicitly listed, or elements inherent to the process, method, product, or device. Without more restrictions, the element defined by the sentence "including a . . . " does not exclude the existence of other identical elements in the process, method, product or device that includes the element. In addition, components, features, and elements with the same name in different examples of this disclosure may have the same meaning or different meanings, and their specific meanings need to be determined by their explanation or further combined with the context in the specific example.

It should be understood that although the terms first, second, or third, etc. may be used herein to describe various information, and the information should not be limited to these terms. These terms are merely used to distinguish the same type of information from each other. For example, without departing from the scope of this disclosure, the first information may also be referred to as the second information, and similarly, the second information may also be referred to as the first information. Depending on the context, the word "if" as used herein can be interpreted as "when" or "while" or "in response to determination". Furthermore, as used in this disclosure, the singular forms "a", "an" and "the" are also intended to include the plural forms, unless the context indicates to the contrary. It should be further understood that the terms "comprising" and "including" indicate the presence of the described features, steps, operations, elements, components, items, types, and/or groups, but do not exclude the existence, appearance or addition of one or more other features, steps, operations, elements, components, items, types, and/or groups. The terms "or" and "and/or" used in this disclosure are interpreted as inclusive or mean any one or any combination. Therefore, "A, B or C" or "A, B and/or C" means "any of the following: A; B; C; A and B; A and C; B and C; A, B and C". An exception to this definition will only occur when the combination of elements, functions, steps or operations is inherently mutually exclusive in some way. In describing the structure of a component, when a layer or an area is referred to as being "on" or "above" another layer or area, it can mean that it is directly on another layer or area, or mean that there are other layers or areas between them. And, if the component is turned over, the layer or area will be "below" or "under" another layer or area. In the example of the present disclosure, "B corresponding to A" means that B is associated with A, and B can be determined according to A. However, it should also be understood that determining B according to A does not mean that B is determined only according to A, and B can also be determined according to A and/or other information.

It should be understood that the specific examples described here are merely used to explain the present disclosure, and are not intended to limit the present disclosure.

In the following description, the use of suffixes about element, such as "module", "part" and "unit" are merely used to describe and best understand this disclosure, and have no specific meaning in itself. Therefore, "module", "part" or "unit" can be used in a mixed manner.

The packing boxes are usually used to package objects. When these boxes are transported, vibrations and bumps can easily happen that will cause damage to objects. The packing boxes in the prior art are usually formed by bending a single well-cut cardboard, for example, a cuboid packing box. Because all the six sides only have a cardboard of single layer or double layers, the buffer capacity of the box is poor, and it's hardly to protect the objects effectively during transportation. In order to improve the buffer effect, more additional buffer materials, such as foam, bubble paper, sponge, paper holder, and etc., are usually filled or set in the box. When making boxes, additional buffer materials increase the cost of the box. In addition, when packing objects, first it is necessary to bend and fix the linear box, then to add buffer materials, and finally to fix the objects with buffer materials. This is a complicated process. When opening the boxes, the buffer material must be taken out first, and then the objects can be taken out. This greatly affects the user's experience and feelings.

To resolve the foregoing technical problems, this disclosure provides a packing box and a cardboard structure. A carrying structure with a deformable buffer part is arranged in the packing box. With the deformable the buffer part can buffer objects by absorbing external vibrations. In addition, the carrying structure and the side wall of the packing box are a bendable one-piece structure, so that when the packing box is made, the carrying structure can be directly obtained by bending, and the carrying structure can be bent into the interior of the packing box, thereby the process of adding buffer materials can be omitted, the production cost of the packing box is reduced, and the packaging process of the packing box is simplified.

The First Example

Figure 2:
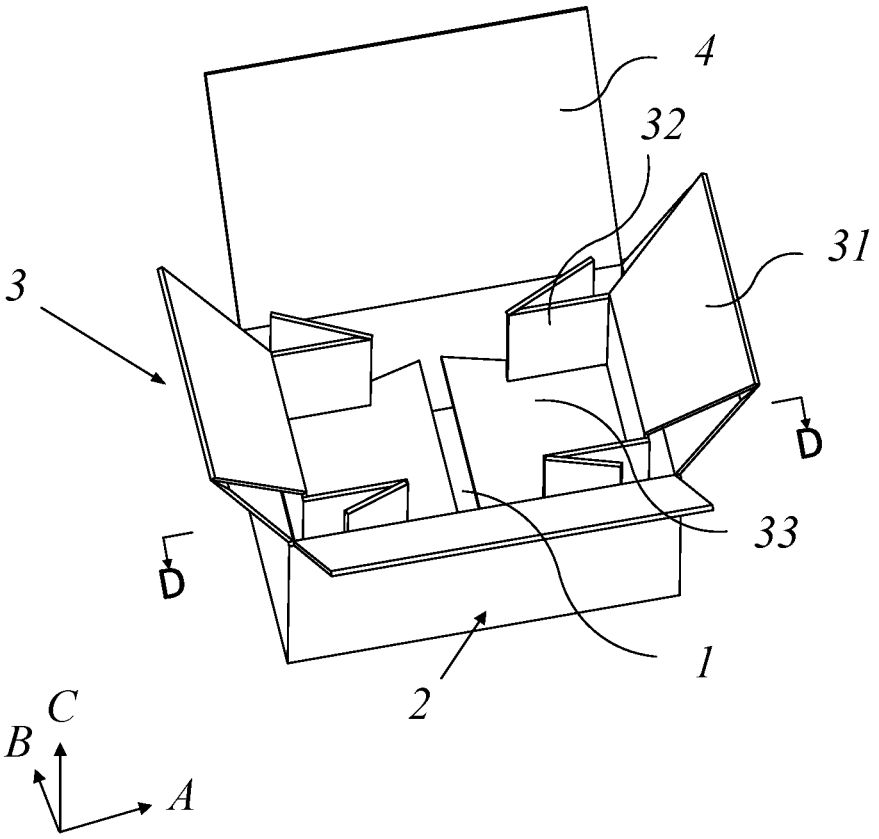
FIG. 2 is the schematic diagram of the packing box when it is opened and no objects have been put in it according to one or more examples of the present disclosure.
Figure 3:
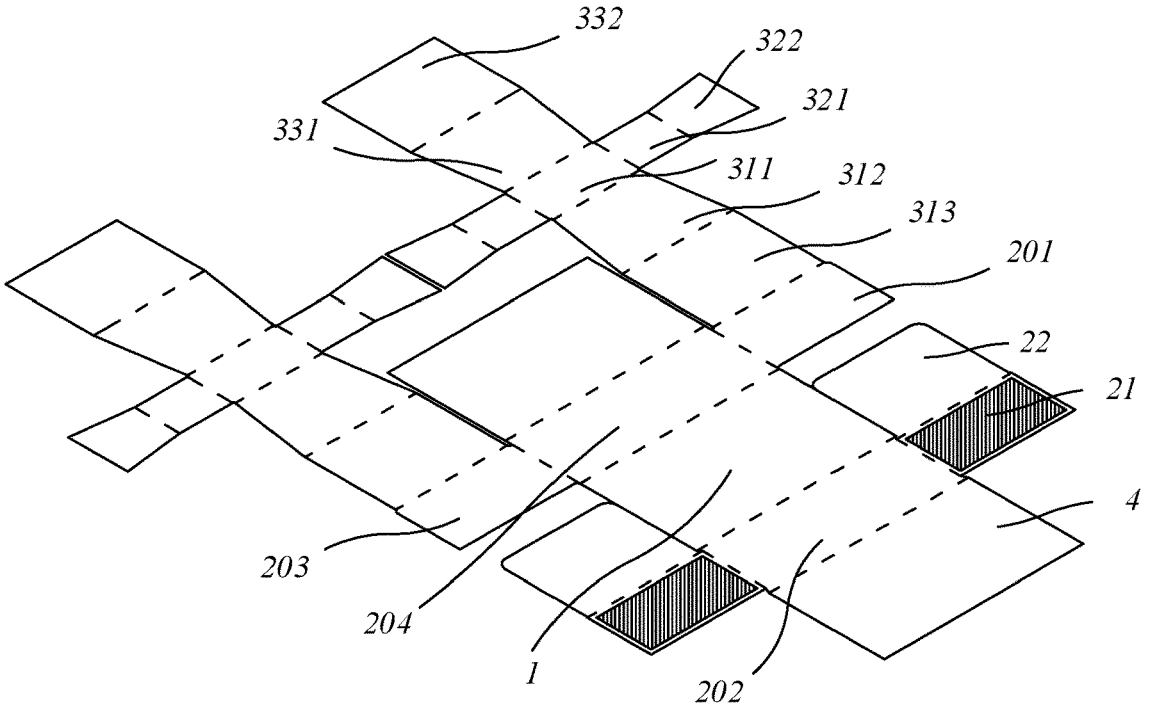
FIG. 3 is the schematic diagram of the packing box when it is expanded according to one or more examples of the present disclosure.

FIG. 1 is the schematic diagram of the packing box according to the first example of the present disclosure when it is closed. FIG. 2 is the schematic diagram of the packing box according to the first example of the present disclosure when it is opened and no object has been put in it. FIG. 3 is the schematic diagram of the packing box according to the first example when it is expanded.

With reference to FIGS. 1 and 2, the packing box of the example in the present disclosure includes: a box body, which further comprises of a bottom 1, a side wall 2 and a containing space; the side wall 2 connects to the bottom 1 and the containing space is formed by the bottom 1 and the side wall 2; a carrying structure 3, positioned in the containing space, and the carrying structure 3 is connected to the side wall 2 with a bendable connection; the carrying structure 3 includes the connecting part 31 and the buffer part 32; wherein the buffer part 32 is connected to both ends of the connecting part 31 along the second direction B; the carrying structure 3 is connected with the side wall 2 through the connecting part 31; the buffer part 32 is a structural component that is connected to the connecting part with a bendable connection, and the buffer part 32 abuts against the side wall 2 with a amount of deformation; the effective space inside the box changes with the deformation of the buffer part 32.

The shape of the box body is not limited, for example, it may be cylindrical, triangular prism, cuboid, or oblique parallelepiped. For the convenience of description, referring to FIGS. 1 to 3, the example of the present disclosure takes cuboid for example. When the packing box is placed on a horizontal surface, the three edges of one vertex of the cuboid structure respectively correspond to three directions, namely, the directions of the length, width, and height of the cuboid structure. Exemplarily, as shown in FIGS. 1 and 3, the first direction A is parallel to the horizontal plane, the second direction B is parallel to the horizontal plane, the first direction A and the second direction B are perpendicular, and the third direction C is perpendicular to the horizontal plane.

The side wall 2 includes a side wall body which comprises of a first wall 201, a second wall 202, a third wall 203 and a fourth wall 204. The first wall 201 and the third wall 203 are a set of opposite wall surfaces in the first direction A. The second wall 202 and the fourth wall 204 are a set of opposite wall surfaces in the second direction B. Both the second wall 202 and the fourth wall 204 are connected to the bottom 1 with a bendable connection, so that the bottom 1 will not be easily opened under the gravity action of the objects that are put inside the box. Both the first wall 201 and the third wall 203 are connected to the second wall 202 or the fourth wall 204 with a bendable connection, so that the bottom 1 and the side wall 2 form a bendable one-piece structure. For easy to cut, both the first wall 201 and the third wall 203 can be connected to the fourth wall 204 with a bendable connection.

In an alternative example, referring to FIG. 2, the bottom 1 and the side wall 2 of the box body form a containing space, and the containing space can contain objects. The bottom 1 and the side wall 2 can be two separate parts, or can be a bendable one-piece structure. Optionally, the bottom 1 and the side wall 2 are a bendable one-piece structure, so that the box body of the packing box can be obtained by bending the entire cardboard that has been well cut. That is to say, when the box body is cuboid, the bottom 1 and the side wall 2 of the box body are a bendable one-piece structure, and the bottom 1 and the side wall 2 are obtained by bending cardboard that has been well cut.

In an alternative example, the carrying structure 3 is put in the containing space of the box body, and is mainly used to hold objects and meanwhile to buffer the objects. Since the carrying structure 3 and the side wall 2 are also a bendable one-piece structure, they can be obtained by a well-cut cardboard at the same time. Exemplarily, the carrying structure 3 is connected to one end of at least one of the first wall 201 or the third wall 203 in the third direction C with a bendable connection. When bending, it can be bent toward the inside of the box body so that the carrying structure 3 is positioned inside the box body.

In an alternative example, referring to FIGS. 2 and 3, the side wall 2 further includes a fixing part 21 and a side wall body; the fixing part 21 is respectively connected to the two ends of the side wall body along the first direction A with a bendable connection; the fixing part 21 is permanently connected to the side wall body. The fixing part 21 can fix the side wall 2 as a whole to form the columnar side surface of the box. Exemplarily, the fixing part 21 is connected to the second wall 202 along the two ends of the side wall body in the first direction A with a bendable connection, and is permanently connected to the inner side of the first wall 201 and the inner side of the third wall 203, so that the side wall 2 forms a complete and solid columnar side. Wherein the fixing part 21 and the side wall 2 can be fixed by sticking.

In an alternative example, the side wall 2 further includes an extension part 22; the extension part 22 is connected to the fixing part 21 with a bendable connection, and at least a part of the bottom 1 is attached to the extension part 22. The extension part 22 can increase the connection performance between the side wall 2 and the bottom 1. Exemplarily, the extension part 22 extends to the inner side of the bottom 1 along the first direction A, and it can block the gap not only between the first wall 201 and the bottom 1 but also between the third wall 203 and the bottom 1.

Figure 4:
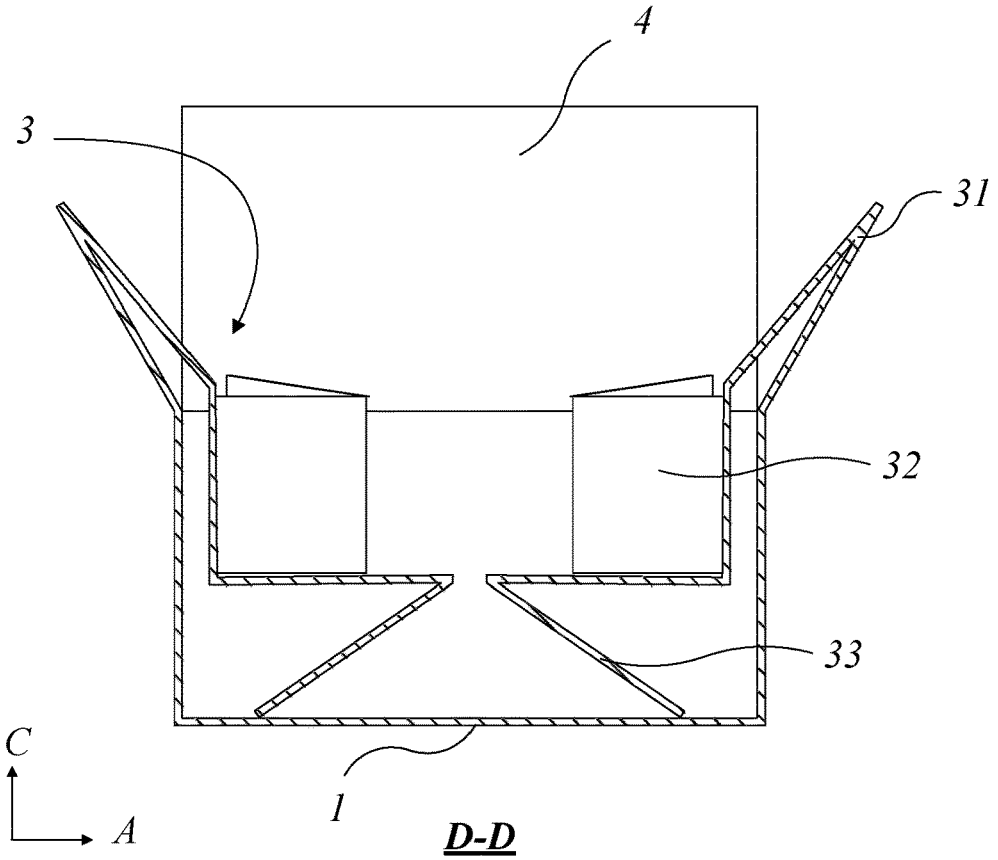
FIG. 4 is the sectional view of the D-D section of the packing box according to the example of the present disclosure in FIG. 2 when it is opened and no objects have been put in it.
Figure 5:
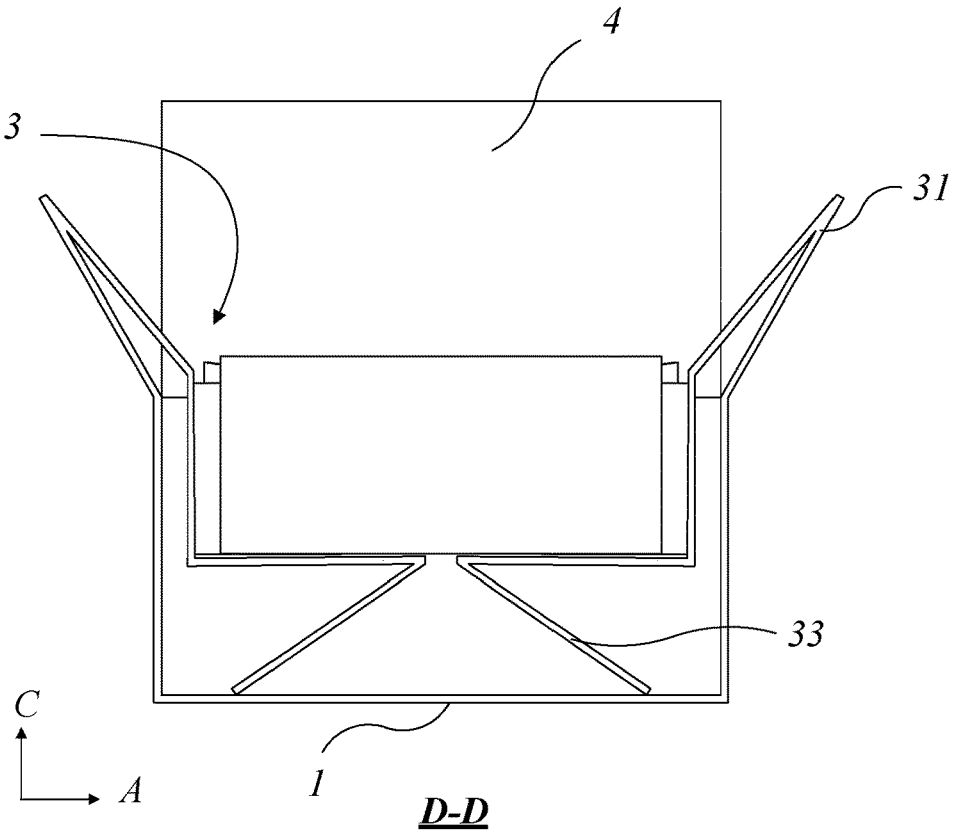
FIG. 5 is the sectional view of the D-D section of the packing box according to the example of the present disclosure in FIG. 2 when it is opened and objects have been put in it.
Figure 6:
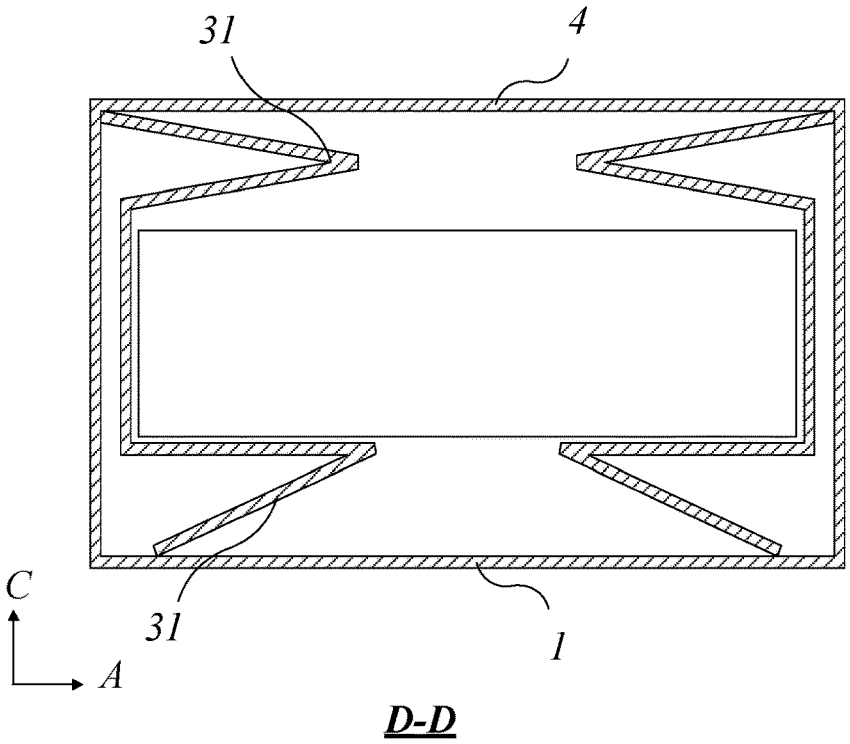
FIG. 6 is the sectional view of the D-D section of the packing box according to the example of the present disclosure in FIG. 2 when it is closed and objects have been put in it.

FIG. 4 is the sectional view of the D-D section of the packing box according to the first example of the present disclosure in FIG. 2 when it is opened and no objects have been put in it. FIG. 5 is the sectional view of the D-D section of the packing box according to the first example of the present disclosure in FIG. 2 when it is opened and objects have been put in it. FIG. 6 is the sectional view of the D-D section of the packing box according to the first example of the present disclosure in FIG. 2 when it is closed and objects have been put in it.

In an alternative example, referring to FIGS. 4 to 6, connecting part is used for connecting the carrying structure 3 and the side wall 2. The buffer part 32 is connected to the two ends of the connecting structure along the second direction B with a bendable connection, and abuts against the side wall 2. When objects are put in the box, the buffer part 32 is positioned between both sides of the object along the second direction B and the side wall 2, so that the buffer part 32 can buffer the objects along the second direction B. Since the buffer part 32 is connected to the connecting part with a bendable connection, the buffer part 32 and the connecting part can also be obtained by bending a well-cut cardboard. In addition, the buffer part 32 is a structure with a deformation amount. When the box body vibrates, the deformable buffer part 32 can absorb the vibration, thereby it has a good buffer effect. It should be noted that at least parts of the connecting part are in contact with the side wall 2 of the object, so that the connecting part can not only position but also buffer the object along the first direction A.

In an alternative example, continuing to refer to FIGS. 4 to 6 along with FIG. 3, the carrying structure 3 further includes a carrying part 33, and the carrying part 33 is connected to a side of the connecting part close to the bottom 1 with a bendable connection, and the carrying part 33 abuts against the bottom 1. The carrying part 33 serves as a main structure for carrying the object. When objects are put in the box, the carrying part 33 supports the objects. The carrying part 33 and the connecting part 31 are one-piece structure that can be bent. Therefore, the carrying part 33 and the connecting part 31 are obtained by bending a well-cut cardboard. In addition, the carrying part 33 can not only carry but also buffer the object along the third direction C.

In an alternative example, referring to FIGS. 4 to 6, the carrying part 33 is an elastic bending structure. The elastic bending structure includes a first bending plate 331 and a second bending plate 332. One end of the first bending plate 331 is connected to the connecting part with a bendable connection. And the other end of the first bending is connected to the second bending plate 332 with a bendable connection. The carrying part 33 is similar to the buffer part 32 with a deformation amount too. Since the elastic bending structure of the carrying part 33 has a certain resilience capability, the carrying part 33 can not only carry but also buffer the object along the third direction C. In addition, when the packing box is opened, the restriction from above is released. Under the rebound action of the elastic bending structure, the object will be lifted from the inside of the box by the carrying part 33. In this way, when the packing box is opened, the rebound effect of automatically raising objects is obtained, which enhances the user's experience and feelings.

In an alternative example, referring to FIGS. 4 to 6 along with FIG. 3, the length of the fold line between the first bending plate 331 and the connecting part is less than that between the first bending plate 331 and the second bending plate 332; the bending angle between the first bending plate 331 and the second bending plate 332 is greater than 90° and less than 180°. The bending angle of the first bending plate 331 and the second bending plate 332 are obtuse angle. So, an acute angle is formed, thus the elastic bending structure of the carrying part 33 has good resilience, therefore the carrying part 33 can have a certain buffer ability. Moreover, the main function of the carrying part 33 is to support objects. So, making the length of the fold line between the first bending plate 321 and the connecting part is shorter than that between the first bending plate 331 and the second bending plate 332, which can make the second bending plate 332 provide a more sufficient supporting effect for the carrying part 33. Since the length of the fold line between the first bending plate 331 and the connecting part 31 is smaller than the length of the fold line between the first bending plate 331 and the second bending plate 332, the area of the second bending plate 332 is larger than that of the first bending plate 331. When the carrying part 33 carries objects, the second bending plate 332 can distribute the weight on the bottom 1. When the carrying part 33 lifts the object, the second bending plate 332 can provide a greater resilience force.

In an alternative example, referring to FIGS. 4 to 6, the buffer part 32 is a buffer bending structure. The buffer bending structure includes a third bending plate 321 and a fourth bending plate 322. The one end of the third bending plate 321 is connected with the connecting part 31 with a bendable connection, the other end of the third bending plate 321 is connected with the fourth bending plate 322 with a bendable connection, and the other end of the fourth bending plate 322 abuts against the side wall 2. The third bending plate 321 and the fourth bending plate 322 form a bending buffer structure with a deformation amount. Since the buffer bending structure has a certain resilience ability, the buffer part 32 can buffer the object along the second direction B. When the object is put in the box, both sides of the object along the second direction B contact with the third bending plate 321. Therefore, the buffer structure can also position the object in the box.

In an alternative example, referring to FIGS. 4 to 6 along with FIG. 3, the length of the fold line between the third bending plate 321 and the fourth bending plate 322 is less than the length of the side line of the fourth bending plate 322 away from the third bending plate 321. The bending angle between the third bending plate 321 and the fourth bending plate 322 is greater than 90° and less than 180°. The bending angle of the third bending plate 321 and the fourth bending plate 322 are obtuse angle. So, an acute angle is formed, thus the elastic bending structure of the buffer part 32 has good resilience, therefore the buffer part 32 can have a good buffer ability. Moreover, since the length of the fold line between the third bending plate 321 and the fourth bending plate 322 is less than the length of the side line of the fourth bending plate 322 away from the third bending plate 321, the area of the third bending plate 321 is smaller than that of the fourth bending plate 322. When objects are put into the box, both the buffer part 32 and the carrying part 33 are positioned between the object and the side wall 2 of the box. For supporting the objects, the first bending plate 331 of the carrying part 33 has a bigger area, so reducing the area of the third bending plate 321 can prevent bending interference between the buffer part 32 and the carrying part 33. Since the main function of the buffer part 32 is buffer, even if the area of the third bending plate 321 is smaller than the area of the fourth bending plate 332, the buffer capacity of the buffer part 32 will not be significantly affected.

In an alternative example, referring to FIGS. 4 to 6 along with FIG. 3, the box body also includes a top cover 4, which is respectively connected to the two ends of the side wall 2 along the second direction B with a bendable connection. The connecting part is a connectable bending structure, the connectable bending structure includes a connecting plate 311, a fifth bending plate 312 and a sixth bending plate 313 that are sequentially connected together with a bendable connection; the buffer part 32 is connected to the connecting plate 311 with a bendable connection; the sixth bending plate 313 is connected to the side wall 2 with a bendable connection; the length of the fold line between the fifth bending plate 312 and the connecting plate 311 is smaller than that between the fifth bending plate 312 and the sixth bending plate 313. The top cover 4 can be separated from the side wall 2, or can be a bendable one-piece structure with the side wall 2. In the example of the present disclosure, the top cover 4 and the side wall 2 are a bendable one-piece structure as an example for description. In order to improve the protection ability of the top cover 4 for the inside of the box, two top covers 4 can be provided, which are respectively connected to the two ends of the side wall 2 along the second direction B by bending together, that is, connected to the second wall 202 and the fourth wall 204 of the box body with a bendable connection (for example, respectively connected to a top edge of the second wall 202 and the fourth wall 204 of the box body along a third direction C with a bendable connection). Therefore, the top cover 4 of the box body can be obtained through the well-cut cardboard. The connectable bending structure of the connecting part also adopts a bending form, which is similar to the carrying part 33. Since the connection part 31 does not need a carrying function, the connecting part 31 realizes the buffer function through the connectable bending structure. The structure of the connectable bending structure and the elastic bending structure may be the same so that the cardboard can be cut easily.

Along the first direction A, two buffer parts 32 can buffer the object. Along the three directions, the carrying part 33 and the connecting part 31 can buffer the object. In addition, the carrying part 33 can also carry and lift the object. Along the second direction B, since the carrying part 33, the connecting part 31 and the buffer part 32 all adopt a deformable bending structure, the area of the connecting part in contact with the object can buffer the object.

The Second Example

Figure 7:
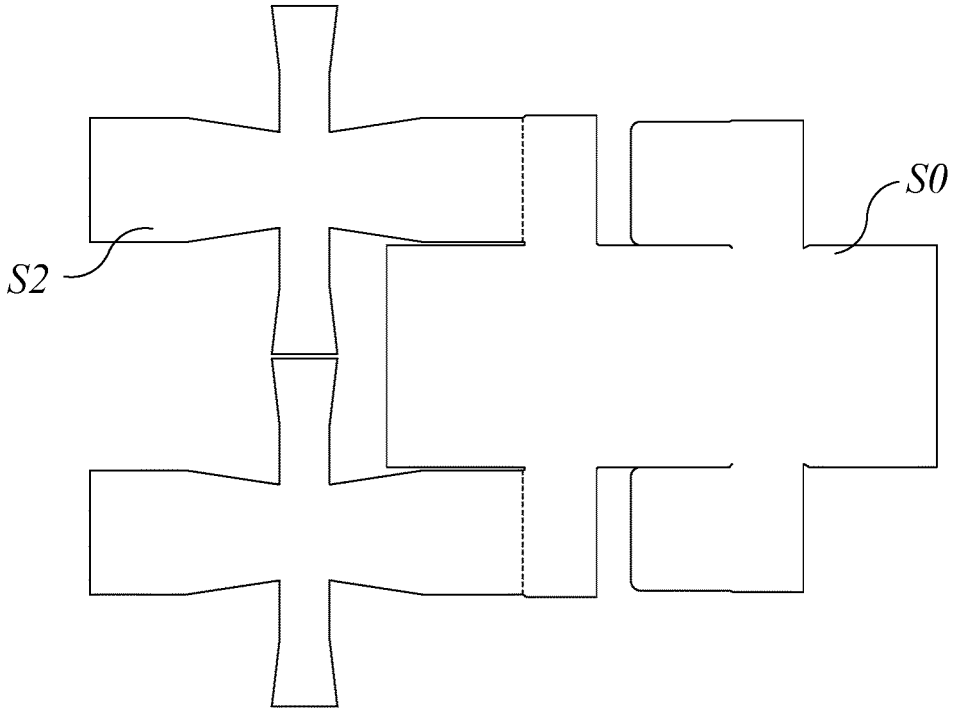
FIG. 7 is a top view of the cardboard structure according to one or more examples of the present disclosure.
Figure 8:
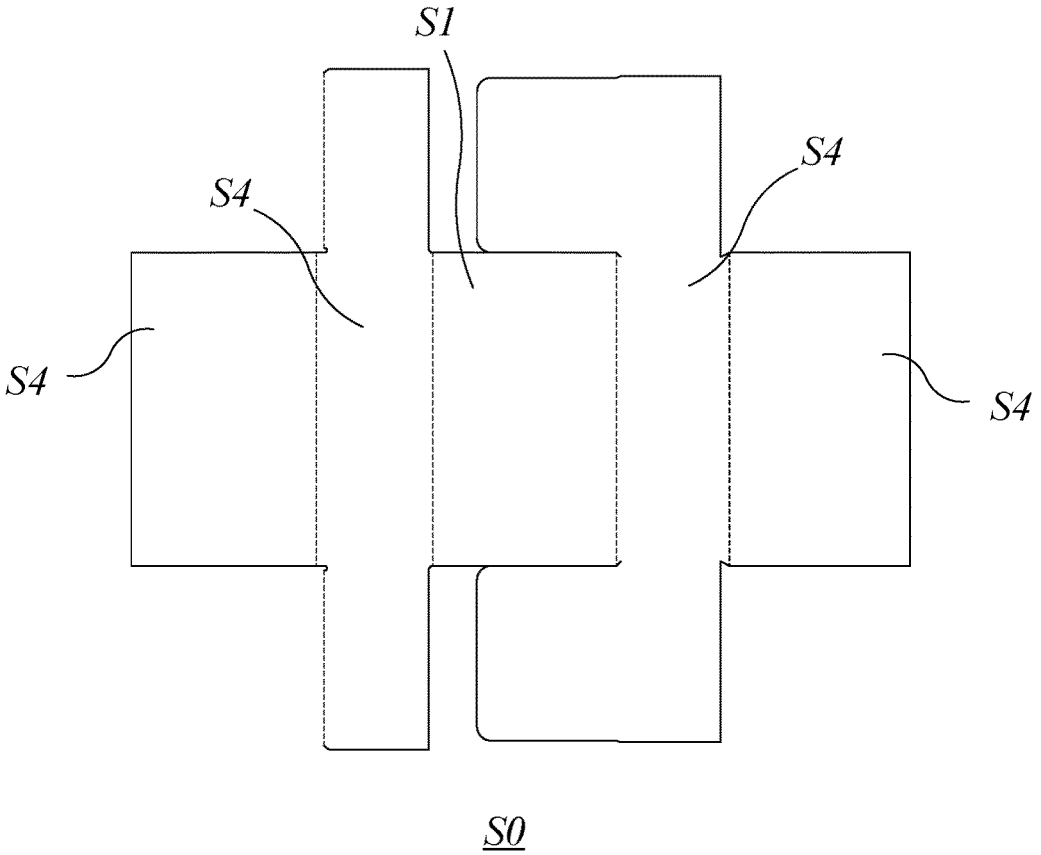
FIG. 8 is a top view of the box body area according to the example of the present disclosure in FIG. 7.
Figure 9:
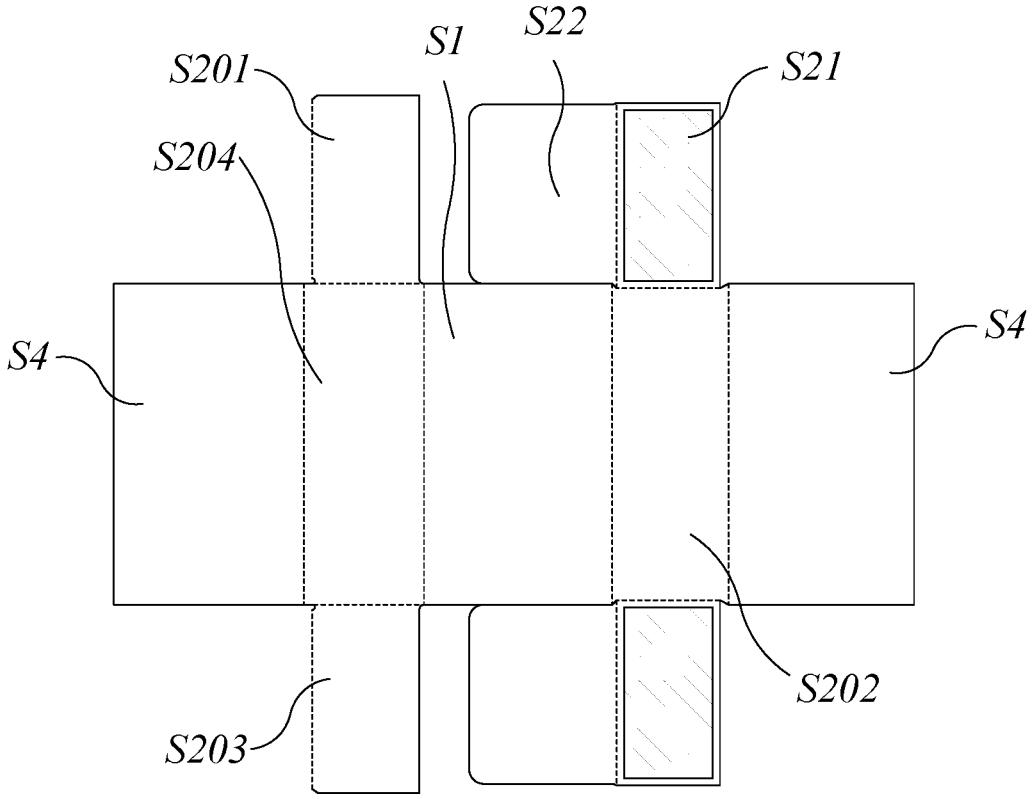
FIG. 9 is a schematic diagram of the box body area of the specific subareas according to the example of the present disclosure in FIG. 8.

FIG. 7 is a top view of the cardboard structure according to the second example of the present disclosure. FIG. 8 is a top view of the box body area according to the second example of the present disclosure in FIG. 7. FIG. 9 is a schematic diagram of the box body area of the specific subareas according to the second example of the present disclosure in FIG. 8.

Referring to FIGS. 7 and 9, the example of the present disclosure provides a cardboard structure, including: a first surface and an opposite second surface; and a box body area S0, including a bottom area 51 and a side wall area S2 that are connected together; the side wall area S2, configured to bend toward the first surface to form the side wall 2; the bottom area 51, configured to bend toward the first surface to form the bottom 1; and the bottom 1 and the side wall 2 form a containing space; the carrying area S3, connected to the box body area S0; and the carrying area S3 is configured to bend toward the first surface to form a carrying structure 3; the carrying area S3, including a connecting subarea S31 and a buffer subarea S32, is positioned in the containing space; the buffer subarea S32 connects to the connecting subarea S31; the connecting subarea S31 and the buffer subarea S32 are respectively configured to bend toward the first surface or the second surface direction at least once to form the connecting part 31 and the buffer part 32; the carrying structure 3 connects to the side wall 2 through the connecting part 31, wherein the buffer part 32 is connected to both ends of the connecting part 31 along the second direction; the buffer part 32 abuts against the side wall 2 with a deformation amount, and the effective space inside the box changes with the deformation of the buffer part 32.

The cardboard structure can be bent to form the packing box of the foregoing example of the present disclosure.

Referring to FIG. 7, when the cardboard structure is not bent, the cardboard structure can be regarded as a plane structure, and the two sides of the plane structure are the first surface and the second surface respectively. It should be noted that when the cardboard structure is bent, bending toward the first surface means that the first surface of the two face-to-face bending parts forms an angle less than 180°, and the second surface forms an angle greater than 180°. Correspondingly, bending toward the second surface, which means that the second surface of the two face-to-face bending parts forms an angle less than 180°, and the first surface forms an angle greater than 180°. The box body area S0 can be obtained by bending, and the shape of the box body is not limited. For the convenience of description, the box body is cuboid as an example. The plane of the cardboard structure defines a first reference direction X and a second reference direction Y that cross each other. The fold lines of the bending cardboard structure are parallel to/coincide with the first reference direction X or the second reference direction Y. Since a box of cuboid is taken as an example for description, the first reference direction X and the second reference direction Y are perpendicular to each other.

Referring to FIG. 8, the side wall area S2 and the bottom area 51 are respectively bent toward the first surface to form a side wall 2 and a bottom 1, and the side wall 2 and the bottom 1 form a containing space. Referring to FIGS. 8 and 9, the side wall area S2 includes a first subarea S201, a second subarea S202, a third subarea S203, and a fourth subarea S204. When the side wall area S2 is folded to form the side wall 2, the first subarea S201, the second subarea S202, the third subarea S203, the fourth subarea S204 respectively forms the first wall 201, the second wall 202, the third wall 203, and the fourth wall 204. The second subarea S202 and the fourth subarea S204 are both connected to the bottom area 51. The first subarea S201 and the third subarea S203 are respectively connected to both ends of the fourth subarea S204 along the second reference direction Y. After the first subarea S201, the second subarea S202, the third subarea S203, and the fourth subarea S204 are bent, the side wall body of the side wall 2 is formed.

In an alternative example, referring to FIGS. 8 and 9, the side wall area S2 also includes at least two fixing areas S21. At least two fixing areas S21 are respectively connected to the two ends of the second subarea S202 along the second reference direction Y. The fixing area S21 is bent toward the first surface to form a fixing part 21, and the second surface of the fixing part 21 is permanently connected to the first surface of the side wall body. Exemplarily, it can be fixed by pasting.

In an alternative example, referring to FIGS. 8 and 9, the side wall area S2 further includes extension area S22, and the extension area S22 is connected to the fixing area S21. The extension area S22 is bent toward the first surface to form an extension part 22, and the second surface of the extension part 22 is attached to at least parts of the first surface of the bottom 1.

In an alternative example, referring to FIGS. 8 and 9, the box body area S0 further includes at least one top cover areas S4, which are connected to the side wall area S2, and the top cover area S4 is bent toward the first surface to form the top cover 4. Exemplarily, there are two top cover areas S4 which are respectively connected to one end of the fourth subarea S204 and the second subarea S202 along the first reference direction X.

Figure 10:
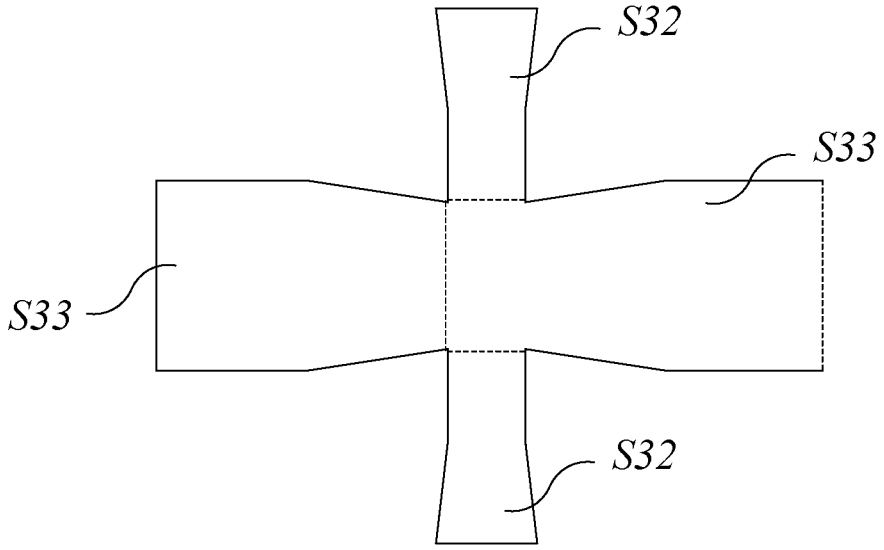
FIG. 10 is a top view of the carrying structure area according to the example of the present disclosure in FIG. 7.

FIG. 10 is a top view of the carrying structure area according to the second example of the present disclosure in FIG. 7.

In an alternative example, referring to FIG. 10, the carrying area S3 is bent toward the first surface, so that the carrying structure 3 which is formed by bending the carrying area S3 is positioned in the containing space. The connecting subarea S31 itself and the buffer subarea S32 itself may be respectively bent at least once, and each bending may be bent in the direction of the first surface or of the second surface. The connecting subarea S31 is bent to form a connecting part 31, and the buffer subarea S32 is bent to form a buffer part 32.

In an alternative example, referring to FIG. 10, the number of buffer subareas S32 is at least two, and the at least two buffer subareas S32 are respectively connected to the two ends of the connecting subarea S31 along the second reference direction Y. The buffer subarea S32 is bent toward the second surface facing to the connecting subarea S31.

In an alternative example, referring to FIG. 10, the carrying area S3 further includes a carrying subarea S33 which is connected to one end of the connecting subarea S31 along the first reference direction X. The carrying subarea S33 is bent toward the second surface facing to the connecting subarea S31. The carrying subarea S33 itself may be bent at least once to form the carrying part 33, and each bending is in the direction of the first surface or of the second surface.

Figure 11:
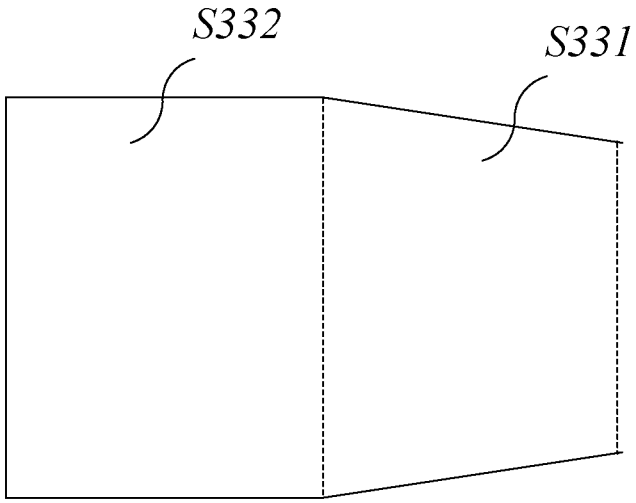
FIG. 11 is a top view of the carrying structure subarea according to the example of the present disclosure in FIG. 10.

FIG. 11 is a top view of the carrying structure subarea according to the second example of the present disclosure in FIG. 10.

In an alternative example, referring to FIG. 11, the carrying subarea S33 includes a first bending area S331 and a second bending area S332. Along the first reference direction X, one end of the first bending area S331 is connected to the connecting subarea S31, the other end of the first bending area S331 is connected to the second bending area S332. The first bending area S331 is bent toward the second surface facing to the connecting subarea S31 to form a first bending plate 331, and the second bending area S332 is bent toward the first surface facing to the first bending area S331 to form a second bending plate 332.

Figure 12:
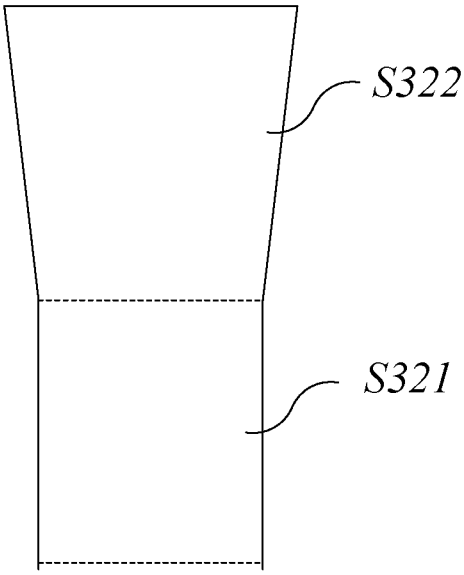
FIG. 12 is a top view of the buffer subarea according to the example of the present disclosure in FIG. 10.

FIG. 12 is a top view of the buffer subarea according to the second example of the present disclosure in FIG. 10.

In an alternative example, referring to FIG. 12, the buffer subarea S32 includes a third bending area S321 and a fourth bending area S322. Along the second reference direction Y, one end of the third bending area S321 is connected to the connecting subarea S31, and the other end of the third bending area S321 is connected to the fourth bending area S322. The third bending area S321 is bent toward the second surface facing to the connecting subarea S31 to form a third bending plate 321, and the fourth bending area S322 is bent toward the first surface facing to the third bending area S321 to form a fourth bending plate 322.

Figure 13:
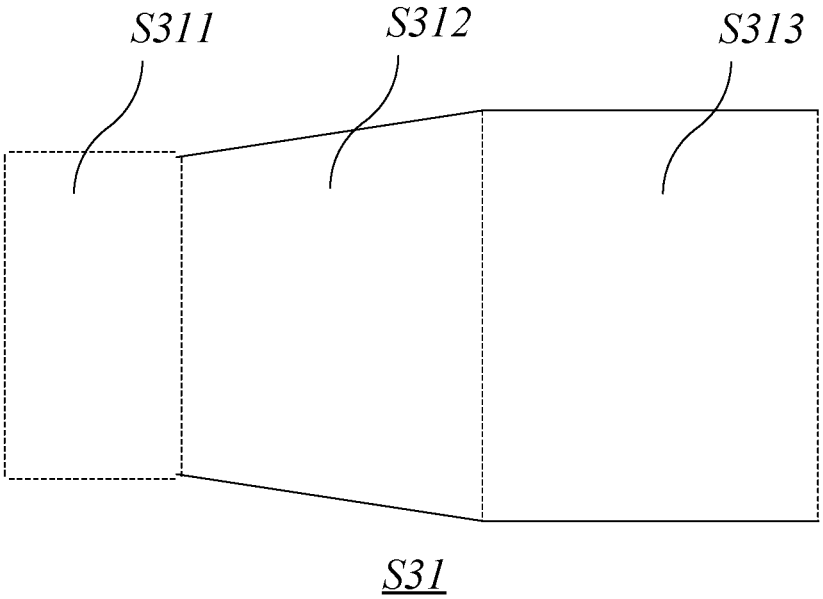
FIG. 13 is a top view of the connecting subarea according to the example of the present disclosure in FIG. 10.

FIG. 13 is a top view of the connecting subarea according to the second example of the present disclosure in FIG. 10.

In an alternative example, referring to FIG. 13, the connecting subarea S31 includes a connecting divisional area S311, a fifth bending area S312, and a sixth bending area S313. Along the first reference direction X, the connecting divisional area S311, the fifth bending area S312, and the sixth bending area S313 are sequentially connected, and the sixth bending area S313 is connected to the side wall area S2. The sixth bending area S313 is bent toward the first surface facing to the side wall area S2 to form a sixth bending plate 313, and the fifth bending area S312 is bent toward the first surface facing to the sixth bending area S313 to form a fifth bending plate 312. The connecting divisional area S311 are bent toward the second surface facing to the fifth bending area S312 to form the connecting plate 311.

The packing box includes: a box body, which further comprises of a bottom, a side wall and a containing space; the side wall connects to the bottom and the containing space is formed by the bottom and the side wall; a carrying structure, positioned in the containing space, is connected to the side wall in one-piece structure with a bendable connection; the carrying structure includes the connecting part and the buffer part; wherein the said buffer part is connected to both ends of the connecting part along the second direction, and the carrying structure connects to the side wall through the connecting part; the buffer part is a structural component that is connected to the connecting part with a bendable connection, and the buffer part abuts against the side wall with a amount of deformation, and the effective space inside the box changes with the deformation of the buffer part.

Optional, the carrying structure also comprises carrying part, and the carrying part connects to the connecting part at a side close to the bottom with a bendable connection, and the carrying part abuts against the bottom.

Optional, carrying part is a flexible bent structure, the flexible bent structure includes a first bending plate and a second bending plate. One end of the first bending plate is connected to the connecting part with a bendable connection, and the other end of the first bending plate is connected to the second bending plate with a bendable connection.

Optional, the length of the fold line between the first bending plate and the connecting part is less than that between the first bending plate and the second bending plate; the bending angle between the first bending plate and the second bending plate is greater than 90° and less than 180°.

Optional, the buffer part is a buffer bending structure; the buffer bending structure includes a third bending plate and a fourth bending plate; one end of the third bending plate is connected to the connecting part with a bendable connection, and the other end of the third bending plate is connected to one end of the fourth bending plate, and the other end of the fourth bending plate abuts against the side wall.

Optional, the length of the fold line between the third bending plate and the fourth bending plate is less than the length of the side line of the fourth bending plate away from the third bending plate; the bending angle between the third bending plate and the fourth bending plate is greater than 90° and less than 180°.

Optional, the side wall further includes fixing part; the fixing part is respectively connected to the two ends of the side wall along the first direction with a bendable connection; the fixing part is permanently connected with the side wall.

Optional, the side wall further includes extension part; the extension part is connected to the fixing part with a bendable connection, and at least a part of the bottom is attached to the extension part.

Optional, it also includes a top cover, which is respectively connected to the two ends of the side wall along the second direction with a bendable connection (for example, the top cover is connected to a top edge of the side wall along a third direction with a bendable connection); the connecting part is a connectable bending structure, the connectable bending structure includes a connecting plate, a fifth bending plate and a sixth bending plate that are sequentially connected together with a bendable connection; the buffer part is connected to the connecting plate with a bendable connection; the sixth bending plate is connected to the side wall with a bendable connection; the length of the fold line between the fifth bending plate and the connecting plate is smaller than that between the fifth bending plate and the sixth bending plate.

Optional, the box forms a cuboid container.

The packing box and the cardboard structure are provided by the embodiments of this application. By arranging the carrying structure with buffer part in the packing box to carry objects, and by using the deformable buffer part to buffer the objects, the buffer capacity of the packing box can be improved thereby. In addition, the carrying structure and the side wall of the packing box are a bendable one-piece structure, so that the carrying structure can be directly obtained by bending, consequently the process of adding buffer materials can be omitted, and the packaging process of the packing box is simplified.

In summary, the examples of the present disclosure provide a packing box and a cardboard structure to improve its buffer capacity by arranging a carrying structure 3 with a buffer part 32 to carry objects. Moreover, since the carrying structure 3 and the side wall 2 are a bendable one-piece structure, the carrying structure 3 can be obtained by bending, so additional buffer materials can be omitted, thereby the manufacturing process of the packing box and the packaging process of the objects are simplified. In addition, when the packing box is opened, the rebound effect of the carrying part 33 can lift the object up, which enhances the user's experience and feeling.

The foregoing descriptions are merely examples of this disclosure, and are not intended to limit this disclosure in any way. Any equivalent structure or equivalent process transformation made to the foregoing examples according to the technical essence of this disclosure, or directly or indirectly used in other related technical fields, shall fall within the scope of the technical solutions of this disclosure.

What is claimed is:

1. A packing box, comprising:

a box body, wherein the box body comprises a bottom, a side wall that is connected to the bottom, and a containing space that is bounded by the bottom and the side wall, and the side wall comprises a side wall body that comprises multiple walls; and a carrying structure disposed in the containing space, wherein the carrying structure comprises a connecting part and a buffer part, the carrying structure connects to the side wall through the connecting part with a bendable connection; and wherein the buffer part is connected to both ends of the connecting part along a second direction, the buffer part abuts against the side wall with deformation, and effective space inside the box changes with the deformation of the buffer part;

wherein the carrying structure comprises a carrying part, the carrying part connects to the connecting part at a side close to the bottom with a bendable connection, and the carrying part abuts against the bottom by forming an angle with the bottom so that the carrying part is capable of carrying and buffering one or more objects placed in the packing box along a third direction that is perpendicular to a horizontal plane that the bottom is located at, the carrying part comprises a flexible bent structure, the flexible bent structure comprises a first bending plate and a second bending plate, a first end of the first bending plate is connected to the connecting part with a bendable connection, and a second end of the first bending plate is connected to the second bending plate with a bendable connection, a bending angle between the first bending plate and the second bending plate is greater than 90° and less than 180°, a length of a fold line between the first bending plate and the connecting part is less than a length of a fold line between the first bending plate and the second bending plate, the second bending plate is capable of distributing weight of the one or more objects on the bottom;

wherein the side wall comprises a fixing part, the fixing part is respectively connected to two ends of a wall of the side wall body along a first direction with a bendable connection, the fixing part is fixedly connected with the side wall body, the first direction is perpendicular to the second direction, and the first direction and the second direction are parallel to the bottom, wherein the side wall comprises an extension part that is connected to the fixing part with a bendable connection, and at least a part of the bottom is attached to the extension part that extends to an inner side of the bottom along the first direction so as to block gaps between one of two walls of the side wall body and the horizontal plane that the bottom is located at, wherein shape of the fixing part is substantially same as the two walls.

2. The packing box of claim 1, wherein the box body forms a cuboid container.

3. The packing box of claim 2, wherein the carrying part and the connecting part are one-piece structure that is bendable.

4. The packing box of claim 3, wherein the second bending plate is capable of providing resilience force when the carrying part lifts the one or more objects.

5. The packing box of claim 1, wherein the buffer part is a structure that connects to the connecting part with a bendable connection;

the buffer part is a bending buffer structure; and the bending buffer structure comprises a third bending plate and a fourth bending plate, wherein a first end of the third bending plate is connected to the connecting part with a bendable connection, and a second end of the third bending plate is connected to a first end of the said fourth bending plate, and a second end of the fourth bending plate abuts against the side wall.

6. The packing box of claim 5, wherein a length of a fold line between the third bending plate and the fourth bending plate is less than a length of a side line of the fourth bending plate away from the third bending plate; or the bending angle between the third bending plate and the fourth bending plate is greater than 90° and less than 180°.

7. The packing box of claim 1, wherein the connecting part is a connectable bending structure; and the connectable bending structure comprises a connecting plate, a fifth bending plate and a sixth bending plate that are sequentially connected with a bendable connection, wherein the buffer part and the sixth bending plate are respectively connected to the connecting plate and the side wall with a bendable connection; or a length of a fold line between the fifth bending plate and the connecting plate is smaller than a length of a fold line between the fifth bending plate and the sixth bending plate.

8. A cardboard structure, comprising:

a first surface of a cardboard;

a second surface of the cardboard that is in the opposite side of the first surface of the cardboard;

a box body area, wherein the box body area comprises a bottom area and a side wall area that are connected together, wherein the side wall area and the bottom area are respectively configured to bend toward the first surface to form a side wall and a bottom, the bottom and the side wall form a containing space, and the side wall comprises a side wall body that comprises multiple walls; and a carrying area that is connected to the box area, wherein the carrying area is configured to bend toward the first surface to form a carrying structure; the carrying structure, comprising a connecting subarea and a buffer subarea, is positioned in the containing space; the buffer subarea connects to the connecting subarea; the connecting subarea and the buffer subarea are respectively configured to bend toward the first surface and the second surface at least once to form a connecting part and a buffer part; and the carrying structure connects to the side wall through the connecting part; and wherein the buffer part is connected to both ends of the connecting part along a second direction, the buffer part abuts against the side wall with deformation, and effective space inside the box changes with the deformation of the buffer part, wherein the carrying structure further comprises a carrying part, the carrying part connects to the connecting part at a side close to the bottom with a bendable connection, and the carrying part abuts against the bottom by forming an angle with the bottom so that the carrying part is capable of carrying and buffering one or more objects placed in the packing box along a third direction that is perpendicular to a horizontal plane that the bottom is located at, the carrying part comprises a flexible bent structure, the flexible bent structure comprises a first bending plate and a second bending plate, a first end of the first bending plate is connected to the connecting part with a bendable connection, and a second end of the first bending plate is connected to the second bending plate with a bendable connection, a bending angle between the first bending plate and the second bending plate is greater than 90° and less than 180°, a length of a fold line between the first bending plate and the connecting part is less than a length of a fold line between the first bending plate and the second bending plate, the second bending plate is capable of distributing weight of the one or more objects on the bottom;

wherein the side wall further comprises a fixing part, the fixing part is respectively connected to two ends of a wall of the side wall body along a first direction with a bendable connection, the fixing part is fixedly connected with the side wall body, the first direction is perpendicular to the second direction, and the first direction and the second direction are parallel to the bottom, wherein the side wall further comprises an extension part that is connected to the fixing part with a bendable connection, and at least a part of the bottom is attached to the extension part that extends to an inner side of the bottom along the first direction so as to block gaps between one of two walls of the side wall body and the horizontal plane that the bottom is located at, wherein shape of the fixing part is substantially same as the two walls.

9. The cardboard structure of claim 8, wherein the carrying part and the connecting part are one-piece structure that is bendable.

10. The cardboard structure of claim 9, wherein the second bending plate is capable of providing resilience force when the carrying part lifts the one or more objects.

11. The cardboard structure of claim 8, wherein the box body area further comprises at least one top cover area, wherein the at least one top cover area is connected to the side wall area, and the at least one top cover area is bent toward the first surface to form a top cover.

* * * * *